US007717776B2

(12) United States Patent
Wagner et al.

(10) Patent No.: US 7,717,776 B2
(45) Date of Patent: May 18, 2010

(54) METHOD AND APPARATUS FOR SUPPLYING ADDITIONAL AIR IN A CONTROLLED MANNER

(75) Inventors: Ernst Werner Wagner, Winsen/Aller (DE); Dieter Lietz, Isernhagen (DE); Marcus Thiem, Hannover (DE)

(73) Assignee: Amrona AG, Zug (CH)

( * ) Notice: Subject to any disclaimer, the term of this patent is extended or adjusted under 35 U.S.C. 154(b) by 137 days.

(21) Appl. No.: 11/952,557

(22) Filed: Dec. 7, 2007

(65) Prior Publication Data

US 2008/0135265 A1 Jun. 12, 2008

(30) Foreign Application Priority Data

Dec. 8, 2006 (EP) ..... 06125707

(51) Int. Cl.
*A62C 35/00* (2006.01)
*A62C 2/12* (2006.01)
*B01L 1/04* (2006.01)

(52) U.S. Cl. ..... 454/369; 169/5; 169/16; 169/54; 169/56; 169/11; 239/69; 454/187

(58) Field of Classification Search ..... 169/45, 169/43, 51, 5, 11, 16, 48, 61, 54, 56, 60; 454/187–193; 165/47; 62/314, 316; 222/53, 222/54, 152; 361/384, 385
See application file for complete search history.

(56) References Cited

U.S. PATENT DOCUMENTS 4,616,694 A * 10/1986 Hsieh ..... 165/47
5,887,439 A 3/1999 Kotliar
7,594,545 B2 * 9/2009 Love ..... 169/45
2003/0226669 A1 12/2003 Wagner
2006/0213673 A1 9/2006 Kotliar

FOREIGN PATENT DOCUMENTS

EP 1 312 392 A1 8/2002
EP 1 475 128 A1 1/2004
EP 1 683 548 A1 1/2005
WO WO 01/78843 A2 10/2001
WO WO 01/78843 A3 10/2001

OTHER PUBLICATIONS

European Patent Office Search Report and Written Opinion, Patent No. 06125707.7-1258, dated Jun. 5, 2007, 5 pages.

* cited by examiner

*Primary Examiner*—Dinh Q Nguyen
*Assistant Examiner*—Justin Jonaitis
(74) *Attorney, Agent, or Firm*—Cesari and McKenna, LLP

(57) ABSTRACT

A method and apparatus for the controlled feeding of added air into a permanently inertized room in which a predefined inertization level is or must be set and maintained within a certain control range provide for the volume flow rate at which an inert gas is fed into the room atmosphere to attain a value that is adequate for maintaining the predefined inertization level in the room atmosphere that will minimize fire risk. In addition, provisions are made whereby at all times just enough fresh air is injected into the room atmosphere as is necessary to remove from the room atmosphere that proportional concentration of hazardous substances that has not already been removed, via a corresponding return-air exhaust system as a result of the injection of inert gas.

23 Claims, 4 Drawing Sheets

METHOD AND APPARATUS FOR SUPPLYING ADDITIONAL AIR IN A CONTROLLED MANNER

BACKGROUND OF THE INVENTION

1. Field of the Invention

This invention relates to a method and apparatus for providing additional supply air in a controlled manner into a permanently inertized room in which a predefined inertization level must be set and maintained within a specific control range.

2. Background Information

An established practice for reducing the risk of a fire in enclosed spaces such as EDP areas, electric switching and power-distribution compartments, sealed-off systems, or storage areas for particularly valuable commodities, has been to permanently inertize them. The preventive effect resulting from such permanent inertization is based on the principle of oxygen displacement. Normal ambient air is known to consist of about 21% by volume of oxygen, about 78% by volume of nitrogen and about 1% by volume of other gases. In order to effectively reduce the risk of a fire developing in a protected area, the so-called "inert-gas technique" is applied to correspondingly reduce the oxygen concentration by injecting into the room concerned an inert gas such as nitrogen. In terms of a fire-extinguishing effect, that level for most combustible solids is known to be reached when the proportional oxygen content has dropped to below 15% by volume. Depending on the specific combustible materials located in the protected area, it may be necessary to reduce the oxygen content even further, for instance to 12% by volume.

In other words, permanent inertization of the protected area down to a so-called "inertization base level", where the proportional oxygen content in the air of the protected area has been reduced to 15% by volume, effectively minimizes the risk of a fire developing in that protected area.

The definition of an "inertization base level" as used herein generally refers to an atmosphere in the protected area which, compared to the oxygen concentration in normal ambient air, is oxygen-depleted, although for medical reasons the oxygen reduction would not be such as to pose a hazard to humans or animals, allowing these to enter the protected area at least briefly and perhaps after taking certain precautions depending on the circumstances. As indicated above, the primary purpose of setting the inertization base level at an oxygen concentration for instance of 13% to 15% by volume is to reduce the risk of a fire developing in the protected area.

In contrast to the inertization base level, the so-called "fully inertized level" corresponds to a proportional oxygen content in the atmosphere of the protected area that has been reduced to a point where effective extinction of a fire begins to take place. Thus, compared to the oxygen content at the inertization base level, the term "fully inertized level" reflects an even lower oxygen concentration at which the combustibility of most materials has already been reduced to a point where an ignition is no longer possible. As a rule, depending on the fire load in the protected area concerned, the fully inertized level is reached at an oxygen concentration of around 11% to 12% by volume. It follows that permanent inertization of the protected area at the fully inertized level not only reduces the risk of a fire developing in the protected area but actually serves to extinguish a fire.

For permanently inertized rooms it is desirable, on the one hand, to build them in relatively air-tight fashion, allowing the inertization level set or to be set to be maintainable with a minimum of inert-gas replenishment. On the other hand, a certain minimum air exchange is generally indispensable even for permanently inertized rooms so as to permit a regeneration of the room atmosphere. For rooms occasionally entered by persons, or occupied by persons for extended periods, that minimum air exchange is needed to allow adequate venting for instance of the carbon dioxide exhaled or the moisture given off by these persons. Considering this example, it is evident that the minimum air exchange required for that room must necessarily be a function of the number of persons and the duration of their activity in the room, with especially the length of time being a variable factor.

To be sure, a minimum air exchange must be provided even for rooms that are essentially never or rarely entered by persons, for instance storage areas, archives or cable pits and ducts. In this case, the minimum air exchange is needed for exhausting potentially harmful components of the room atmosphere caused for instance by fumes emanating from equipment housed in the room at issue.

If the enclosure of the room concerned is sealed in nearly hermetic fashion as is usually the case especially in permanently inertized rooms, an uncontrolled air exchange can no longer take place. Enclosed spaces of that nature therefore make it necessary for a technical or mechanical ventilation system to provide that minimum air exchange. The term "technical ventilation" collectively refers to a venting system for drawing out hazardous substances or biological agents present in a room. In the case of rooms in which persons perform activities, the dimensioning of a technical ventilation system, especially the blower output, air exchange rate and air flow velocity, depends on the time-weighted average concentration of a substance in the room atmosphere at which any acute or chronic damage to a person's health is not to be expected. Venting the room permits an air exchange between the outside and the interior atmosphere. In general terms, the required minimum air exchange serves to remove toxic, hazardous substances, gases and aerosols to the outside and to inject needed substances, especially oxygen, into rooms in which people are present. The following description will refer to these toxic substances that are to be removed from the enclosed-space atmosphere through the minimum air exchange simply as "hazardous substances".

Large rooms or rooms in which the atmosphere contains a large amount of hazardous substances are now typically equipped with a mechanical ventilation system that ventilates the room either continuously or at preset times. The ventilation systems usually employed are designed to feed fresh air into the object room and to draw out spent or polluted air. Depending on the intended application, these are systems providing a controlled air intake (so-called "added-air systems"), or a controlled return air exhaust (so-called "air exhaust systems"), or they are combination air intake and exhaust systems.

The drawback of using this type of ventilation system for permanently inertized rooms, however, is that due to the air exchange, it is necessary to continuously feed inert gas into the permanently inertized room at a relatively high rate in order to maintain the preset level of inertization. It follows that, when mechanical ventilation is employed, maintaining the atmosphere in a permanently inertized room at the inertization base level or fully inertized level requires the supply of relatively large amounts of inert gas per time unit, produced for instance by appropriate on-site inert-gas generators. These inert-gas generators must have a correspondingly high output capacity, which in turn increases the operating cost of permanent inertization. Moreover, to produce inert gas, these generators use up a relatively large amount of energy. Therefore, from the economic point of view, applying inert-gas technology whereby a room is permanently inertized at the inertization base level or the fully inertized level for minimizing the risk of fire, entails relatively high operating costs whenever the permanently inertized room requires that minimum air exchange.

SUMMARY OF THE INVENTION

Addressing the problem described above, it is one objective of this invention to introduce a method as well as apparatus so designed as to efficaciously and economically supply a permanently inertized room with added air in a manner whereby the specified air exchange rate in the room is maintained while at the same time permitting on a lasting basis the effective suppression of the risk of a fire or explosion in the room concerned.

This objective is achieved by means of a method of the type referred to above, in that the method includes the following procedural steps: A source of inert gas, specifically an inert gas generator and/or inert gas reservoir, is provided for supplying an inert gas, for instance an air-nitrogen mixture. Next, the inert gas thus made available is fed into the atmosphere of the permanently inertized room via a first feed line system, in controlled fashion at a first volume flow rate, the first volume flow rate being so gauged as to maintain the preset inertization level in the internal atmosphere of the permanently inertized room while displacing from that atmosphere hazardous substances, in particular toxic and other damaging substances, biological agents and/or moisture. The method according to this invention additionally employs a fresh air source which then feeds fresh air, in particular outside air, into the atmosphere of the permanently inertized room via a second feed system, in controlled fashion and at a second volume flow rate. According to the invention the value, i.e. the time-based mean value of the second flow rate at which the fresh air is fed into the atmosphere of the enclosed space, is determined by both the minimum air exchange rate required for the permanently inertized room and the value, i.e. time-based mean value, of the first volume flow rate at which the inert gas is fed into the internal atmosphere of the room.

The term "volume flow rate" or, respectively, "air exchange rate" refers in each case to the volume flow or air exchange per given time unit. Similarly, the term "added air rate" refers to the amount of added air fed into the internal atmosphere of the room per given time unit, the term "amount of air intake" in turn referring to the total amount of air and gas fed into the internal atmosphere of the room. In the case of a permanently inertized room, for example, receiving a certain amount of replenishing inert gas per time unit for maintaining the preset inertization level while also receiving per time unit (in addition to the inert gas) a certain, controlled amount of fresh air, the added air rate is the sum of the inert-gas rate and the fresh-air rate.

The advantages achievable with the solution according to the invention are obvious: In particular, it is a method that is especially easy to implement yet effective in providing a permanently inertized room, at very low cost, with an adequate supply of added air, thus maintaining the specified (minimum) air exchange rate of the room while also allowing the inertization level preset in that room to be maintained, effectively suppressing the risk of a fire.

As used in this description, the term "added air" generally refers to the air and gas combination that is fed into the permanently inertized room for scavenging from that room undesirable hazardous substances, in particular toxic or otherwise harmful i.e. hazardous substances, biological agents and/or moisture (water vapor). Specifically, the injection of added air serves the purpose of displacing to the outside the toxic pollutants, gases and aerosols which over time have accumulated in the inner atmosphere of the room, thus in essence "purging" the room air.

By selectively setting the value, i.e. the time-based mean value of the second volume flow rate at which fresh air is injected into the enclosed-room atmosphere, as a function of the minimum air exchange rate needed for the permanently inertized room and of the value or time-based mean value of the first volume flow rate at which the inert gas is fed into the enclosed-room atmosphere for maintaining the predefined inertization level, it is possible to inject into the atmosphere of the permanently inertized room precisely that amount of added air that is actually required to ensure the necessary minimum air exchange. Significantly, the fact that the second volume flow rate is advantageously tied to temporal variations of the necessary minimum air exchange rate and/or the first volume flow rate, also permits compensation for potentially occurring time-related fluctuations of the minimum air exchange needed. Conceivably, the value or time-based mean value of the second volume flow rate can be adaptively selected as a function of the minimum air exchange rate actually needed at any given time for the permanently inertized room or as a function of the respective current value of the first volume flow rate.

Of course, it is equally possible even in the design stage to pre-establish the required first and/or second volume flow rate at which the inert gas and, respectively, the fresh air are injected into the room atmosphere, based on the known or perhaps estimated (or calculated) minimum air exchange rate needed for the permanently inertized room.

Another possible alternative solution would be to predetermine in the design stage only the second volume flow rate at which the fresh air is to be added to the room atmosphere, on the basis of the expected value of the first volume flow rate and the known or perhaps estimated (or calculated) minimum air exchange rate needed for the permanently inertized room.

It should be pointed out that the term "value of the volume flow rate" as used in these specifications is to be understood as the (time-based) mean value of the volume flow rate per unit of time.

In permanently inertized rooms, for example, which are occasionally entered by people, the minimum air exchange, meaning the air exchange required for removing from the room atmosphere toxic or other harmful or hazardous substances, gases and/or aerosols (hereinafter collectively referred to as "hazardous substances") at a rate that reduces the concentration of such hazardous substances in the room atmosphere to a level sufficiently low, from the medical perspective, to be safe for living beings, depends for instance on the number of persons entering and/or the duration of their activity in the room and therefore it is not a specific time constant. In the case of permanently inertized rooms serving for the storage of certain products which over time emit (exude) hazardous substances, the necessary air exchange additionally depends on the rate at which these hazardous substances are emitted.

Moreover, in the solution according to this invention, the value or time-based mean value of the first volume flow rate at which the inert gas supplied by the inert-gas source is fed into the atmosphere of the permanently inertized room via the first feed line system, can be so set or regulated that the oxygen concentration in the permanently inertized room will not exceed a predefinable level. This predefinable level (including a certain control range) may for instance be adapted to the inertization level pre-set for and to be maintained in the permanently inertized room.

Significantly, the method according to the invention allows for the controlled injection, into the atmosphere of the permanently inertized room, of inert gas at the first volume flow rate and the controlled injection of fresh air at the second volume flow rate, the combined amount of added air per unit of time being so dimensioned as to maintain the specified inertization level in the permanently inertized room while at the same time ensuring the necessary minimum air exchange rate. Since the air injected into the room atmosphere consists of a certain fresh-air component and an inert-gas component, it is possible to provide the necessary air exchange in particularly cost-effective fashion even in permanently inertized rooms.

In this context, it should be noted that the term "inert gas" as used herein refers in particular to oxygen-depleted air. For example, such oxygen-depleted air may be nitrogen-enriched air.

It follows that in permanently inertized rooms, for example, which are occasionally entered by persons and in which, ideally, no toxic hazardous substances especially by the emission or evaporation of highly volatile substances are present, the only exception being the carbon dioxide exhaled by these persons or the humidity generated through their activity in the room, the air intake needed for that room per time unit, i.e. the amount of added air which in accordance with this invention is controlled by way of the value or time-based mean value of the second volume flow rate and by way of the value or time-based mean value of the first volume flow rate, depends on the carbon dioxide and moisture content and, respectively, the oxygen depletion in the room atmosphere.

Accordingly, in this (idealized) example the minimum air exchange rate needed for the permanently inertized room would have a value of "zero" for as long as there are no persons in the permanently inertized room and consequently no substances that need to be removed (carbon dioxide, moisture) are generated in the atmosphere of the permanently inertized room.

In applying the proposed solution, the value of the second volume flow rate at which fresh air is injected in the room atmosphere will be set at zero while the value of the first volume flow rate at which inert gas is fed into the room atmosphere will suffice to maintain the room atmosphere at the specified inertization level.

However, when the room is entered by one or several persons, as a result of which (after a certain time) the carbon dioxide and/or humidity concentration in the room atmosphere exceeds a predefinable critical setpoint value, a minimum air exchange will be necessary to keep the carbon dioxide and humidity components in the room atmosphere at a non-toxic i.e. non-damaging level or, as the case may be, to reduce these components to an innocuous level. At the same time, the first volume flow rate at which the inert gas is fed into the room atmosphere must assume a value that suffices for maintaining the specified inertization level in the room atmosphere.

Since in establishing the value of the second volume flow rate it is not only the concentration of hazardous substances that have to be removed from the atmosphere of the permanently inertized room but also the value of the first volume flow rate at which inert gas is injected in the room atmosphere that must be considered with regard to the fact that the inert-gas feed contributes a certain amount to the necessary minimum air exchange, the solution according to the invention provides for just enough fresh air being injected in the atmosphere of the permanently inertized room as is absolutely necessary to remove from the room atmosphere that hazardous-substance component that has not already been removed by the injection of the inert gas, for instance via a return-air exhaust system.

Conceivably, then, in a case where the minimum air exchange rate required is small enough, the amount of inert gas injected in the room atmosphere per time unit may already suffice for the necessary air exchange, obviating the need for adding fresh air. In other words, in this case the inert gas introduced at the first volume flow rate already provides adequately for the needed minimum air exchange.

With regard to the apparatus, the objective of this invention is achieved in that the apparatus encompasses the following: An inert-gas source, in particular an inert-gas generator and/or an inert-gas reservoir for supplying an inert gas; a fresh-air source for supplying fresh air, especially outside air; a first feed line system that can be connected to the inert-gas source and permits the controlled i.e. regulated feeding of the inert gas into the atmosphere of the permanently inertized room at a first volume flow rate so gauged as to maintain the specified inertization level and to adequately remove from the room atmosphere hazardous substances, in particular toxic or other hazardous substances, biological agents and/or moisture; and a second feed line system for the controlled supply of available fresh air into the atmosphere of the permanently inertized room at a second volume flow rate. According to the invention, the value of the second volume flow rate at which the fresh air is injected depends both on the minimum air exchange rate required for the permanently inertized room and on the value of the first volume flow rate at which the inert gas is injected.

The apparatus referred to is a hardware implementation of the method, discussed above, for the controlled intake of added air into a permanently inertized room. It will be self-evident that the advantages and features mentioned in connection with the method according to the invention are achievable in analogous fashion with the apparatus according to the invention.

Advantageous enhancements are described in the dependent claims.

In one particularly preferred, enhanced embodiment of the method according to the invention, the concentration of the hazardous substances in the room atmosphere is measured in one or several locations within the permanently inertized room by means of one or several sensors in preferably continuous fashion or at scheduled times or events. A particularly desirable implementation preferably employs an aspirator-type hazardous-substance measuring unit incorporating at least one and preferably several hazardous-substance detectors operating in parallel, and the measured value of the hazardous-substance concentration, recorded continuously or at scheduled times or events, is transmitted to a minimum of one controller.

This minimum of one controller may be designed to regulate the value of the first volume flow rate at which the inert gas is fed to the atmosphere of the permanently inertized room as a function of the inertization level that is to be maintained in the permanently inertized room. However, as an alternative or in addition, it is possible to design the controller in a manner whereby it regulates the value of the first volume flow rate at which the inert gas is injected as a function of the minimum air exchange rate needed for the permanently inertized room and/or of the value of the first volume flow rate at which the inert gas is injected.

The controller may be capable of regulating the value of the second volume flow rate in adaptation to the minimum air exchange rate needed for the permanently inertized room at any given time and/or to the respective value of the first volume flow rate.

Of course, it is also possible to pre-establish, as early as in the design stage, the specific second volume flow rate at which the fresh air is injected into the room atmosphere in adaptation to the known or perhaps estimated minimum air exchange rate required for the permanently inertized room and/or to the air-tightness of the room enclosure, or the associated $n_{50}$ value.

The advantage of employing several hazardous-substance detectors working in parallel for registering the concentration of hazardous substances in the room atmosphere consists primarily in the fail-safe operation of the hazardous-substance measuring system. Since the concentration of the hazardous substances is registered by the controller in preferably continuous fashion or at scheduled times or events, it is advantageously possible for the controller, concurrently with the hazardous-substance measurement, to determine and adjust the minimum air exchange needed for the permanently inertized room.

The system according to the invention thus knows the minimum air exchange rate that needs to be maintained in the room, making it possible for the value of the second volume flow rate at which fresh air is supplied to the room atmosphere to be adapted, preferably in continuous fashion, to that minimum air exchange rate required for the permanently inertized room. As has been explained above, the value of the added air intake rate (i.e. the amount of added air injected per time unit into the permanently inertized room) is composed of the value of the first volume flow rate and the value of the second volume flow rate (meaning the amount, per time unit, of the inert gas injected into the room atmosphere and, again per time unit, of the fresh air injected into the room atmosphere). The minimum air intake rate required is the amount, per time unit, of the added air to be injected into the atmosphere of the permanently inertized room that is just enough to remove the hazardous substances etc. from the room atmosphere to a point where the concentration of these hazardous substances is just low enough to be safe for persons or for products stored in the permanently inertized room.

One particularly preferred implementation of the solution according to the invention additionally includes provisions whereby the oxygen concentration in the permanently inertized room is measured in one or several locations within the room atmosphere, preferably in continuous fashion or at scheduled times or events. Conceivably, a preferably aspirator-equipped oxygen measuring device could be installed, employing at least one and preferably several oxygen sensors working in parallel for measuring the oxygen concentration in the atmosphere of the permanently inertized room either continuously or at scheduled times and events and for sending the measured values to the controller.

For fail-safe considerations, the oxygen measuring system should preferably employ several oxygen sensors working in parallel. Since the controller knows the oxygen concentration in the atmosphere of the permanently inertized room at any given time, it can regulate the value of the first volume flow rate at which the inert gas is fed into the room atmosphere to a point where it maintains the inertization level specified for the permanently inertized room (within a certain control range where appropriate). It follows that the system according to the invention provides adequate protection against fire and, if the oxygen concentration in the room atmosphere corresponding to the specified inertization level is sufficiently low, against explosions as well, the controlled air exchange in the atmosphere of the permanently inertized room notwithstanding.

Since according to the invention the added air intake rate needed to ensure the required minimum air exchange takes into account not only the value of the second volume flow rate at which fresh air is injected into the room atmosphere but also the value of the first volume flow rate at which inert gas is fed into the room atmosphere, the air intake into the room atmosphere per time unit will always be just enough to provide that minimum air exchange. To that effect, the value of the second volume flow rate is ideally set at a point corresponding to the difference between a minimum added-air volume flow rate, or air intake rate, required for maintaining the minimum air exchange rate in the permanently inertized room, and/or the value of the first volume flow rate for maintaining the specified inertization level. Of course, it is also possible to purposely select a slightly higher value for the second volume flow rate to provide a guaranteed extra safety margin with regard to the necessary minimum air exchange.

In the solution according to the invention, the above-mentioned minimum added-air volume flow rate, or air intake rate, that is needed for maintaining the required minimum air exchange rate in the permanently inertized room, can be determined by that minimum of one controller as a function of the measured concentration of hazardous sub-stances in the atmosphere of the permanently inertized room. Conceivably this could be accomplished by means of a look-up table provided in the controller and establishing a relation between the measured concentration of hazardous substances and the necessary minimum added-air volume flow rate. To make the system as flexible as possible for adaptation to potentially changing hazardous-substance concentrations in the atmosphere of the permanently inertized room, provisions are preferably made whereby, in continuous fashion or at scheduled times or events, the controller determines the necessary minimum added-air volume flow rate.

As an alternative, the second volume flow rate at which fresh air is injected into the room atmosphere can be predetermined, especially in the system design stage, on the basis of the known or perhaps estimated minimum air exchange rate needed, with this determination preferably also taking into account the air tightness of the enclosure of the permanently inertized room, i.e. the $n_{50}$ rating of the room.

Preferably, the basic functionality of the controller is such as to increase the minimum air exchange rate required for the permanently inertized room as the concentration of hazardous substances builds up, and to appropriately reduce it as the concentration of hazardous substances decreases.

On the other hand, the controller should be so designed that, based on the required minimum air exchange rate and on the value of the first volume flow rate and preferably by controlling a valve integrated in the second feed line system, it adjusts the value of the second volume flow rate in a manner whereby that value of the second volume flow rate is greater than or equal to the difference between the minimum added-air volume flow rate needed for maintaining the minimum air exchange required for the permanently inertized room and the first volume flow rate serving to maintain the specified inertization level in the atmosphere of the permanently inertized room.

Of course it would also be possible to design the controller in a way whereby, based on the minimum air exchange rate and on the value of the second volume flow rate perhaps predetermined in the system design stage and preferably by controlling a valve integrated in the first feed line system, the value of the first volume flow rate is adjusted to a point greater than or equal to the difference between the minimum added-air volume flow rate required for maintaining the minimum air exchange needed in the permanently inertized room and the pre-established second volume flow rate, without, of course, neglecting the fact that the first volume flow rate should in any event assume a value that is required for maintaining the specified inertization level in the atmosphere of the permanently inertized room.

For collecting the controller-determined values of the first and second volume flow rates serving to maintain the specified inertization level in the permanently inertized room and, respectively, the required minimum air exchange rate, a preferred embodiment of the system according to the invention includes the provision of at least one sensor each in one or several locations within the first and the second feed line systems, allowing the first and, respectively, second volume flow rate to be measured, preferably in continuous fashion or at scheduled times or events, and the measured values to be transmitted to the controller.

The fresh-air source may for instance be in the form of a system that draws in "normal" outside air, in which case the fresh air supplied by the fresh-air source is ambient outside air.

A particularly preferred embodiment of the apparatus according to the invention additionally encompasses a return-air exhaust unit so designed that return air is exhausted from the atmosphere of the permanently inertized room in controlled fashion. This return-air exhaust unit may for instance be a ventilation system that works by the pressurized ventilation principle, whereby the injection of added air generates a certain pressurization of the permanently inertized room, so that the differential pressure causes part of the room air to be removed from the permanently inertized room via a suitable return-air exhaust duct system. Of course, it would also be possible to use a fan-based return-air exhaust system that actively draws out the room air.

In the last-mentioned configuration in which the apparatus for the controlled intake of added air into the permanently inertized room also employs a return-air exhaust system, a particularly preferred feature provided in the latter is an additional air reprocessing unit serving to reprocess and/or filter the return air removed from the room by the return-air exhaust system and to subsequently recirculate at least part of the reprocessed or filtered air, constituting newly available inert gas, back to the inert-gas source. In that case, the air reprocessing unit should be capable of filtering out any toxic or otherwise harmful, hazardous substances, gases and aerosols, so that the filtered return air is directly reusable as an inert gas.

In the latter configuration, the air reprocessing unit could conceivably encompass a molecular separation system, in particular a hollow-fiber membrane system, a molecular screen system and/or an activated-charcoal adsorption system for the molecular filtering of the return air exhausted from the room.

In a case where the inert-gas source is an inert-gas generator incorporating a membrane system and/or an activated-charcoal adsorption system and feeding a compressed air mixture to the inert-gas generator, which inert-gas generator then delivers a nitrogen-enriched air mixture, it would be possible for the air mixture that is fed to the inert-gas generator to contain at least part of the filtered return air.

In a particularly preferred invention embodiment, the return-air exhaust system encompasses at least one controllable exhaust gate, especially a mechanically, hydraulically or pneumatically controllable exhaust shutter that can be operated in a manner whereby the return air can be exhausted from the permanently inertized room in controlled fashion. The exhaust shutter could conceivably be in the form of a fire barrier.

As a specific, desirable feature in the above-described preferred configuration of the device according to the invention which includes the return-air exhaust system and the air reprocessing unit, the oxygen content in the part of the filtered return air that is fed to the inert-gas source as an inert gas, is at most 5% by volume, making this a very economically operating system.

With regard to the specific level that can be set for the permanently inertized room, it should remain below the oxygen content of the outside air and above the specified inertization level that is to be maintained in the permanently inertized room.

Finally, preferred for economic considerations in the above-described enhanced configurations of the device according to the invention, provided with an inert-gas source as well as a fresh-air source, the proportional oxygen content in the inert gas supplied by the inert-gas source is 2 to 5% by volume, while the proportional oxygen content in the fresh air supplied by the fresh-air source is about 21% by volume. Of course, other percentages can also be used.

With regard to the method according to the invention, a preferred implementation additionally includes the generation of inert gas. It is thus possible, by means of suitable equipment, to produce on site the inert gas that may have to be admixed to the added air being injected into the permanently inertized room.

As another preferred feature, the method includes the additional procedural step of a controlled removal of the return air from the permanently inertized room by means of a corresponding return-air exhaust system as well as the procedural step of filtering the return air removed from the room by means of the return-air exhaust system and making at least part of the filtered return air available for use as an inert gas.

Finally, it would also be possible to measure the oxygen content in the atmosphere of the permanently inertized room, preferably in continuous fashion or at scheduled times and events, with the procedural step of regulating the volume flow rate of the inert gas supplied by the inert-gas source and regulating the volume flow rate of the fresh air supplied by the fresh-air source taking place as a function of the measured oxygen content.

The following will describe preferred embodiments of the apparatus according to the invention.

DETAILED DESCRIPTION OF AN ILLUSTRATIVE EMBODIMENT

Figure 1:
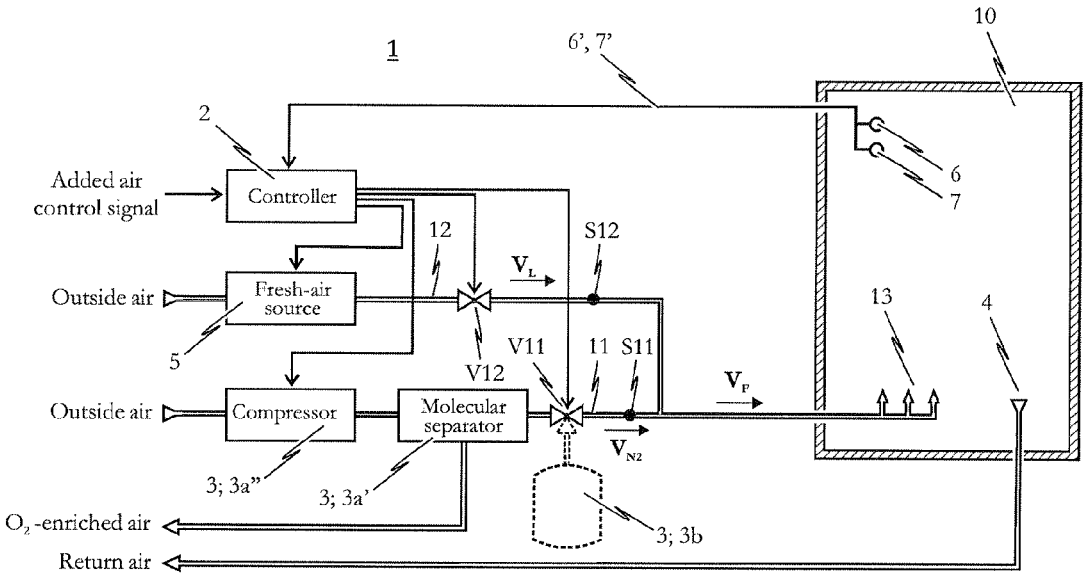
FIG. 1 shows a first preferred embodiment of the apparatus according to the invention for the controlled intake of added air into a permanently inertized room.

FIG. 1 is a schematic illustration of a first preferred embodiment of the apparatus 1 according to this invention for the controlled intake of added air into a permanently inertized room 10. As depicted, the apparatus 1 for the controlled injection of added air into the permanently inertized room 10 functions as an air supply regulating system essentially encompassing a controller 2, a fresh-air source 5 supplying fresh air (in this case ambient outside air) and an inert-gas source 3 supplying an inert gas such as nitrogen-enriched air.

The apparatus 1 according to the invention, shown in FIG. 1, additionally includes a first feed line system 11 and a second feed line system 12 for the controlled feeding of available inert gas and, respectively, of the available fresh air into the atmosphere of the permanently inertized room 10. The two feed line systems 11, 12 connect the inert-gas source 3 and, respectively, the fresh-air source 5 to an inlet nozzle system 13 provided in the permanently inertized room 10.

In all of the configurations here described, the inlet nozzle system 13 is designed as a common nozzle assembly jointly used for the intake of both inert gas and fresh air; of course, it would be equally possible to install separate nozzle assemblies.

Each of the first and second feed line systems 11 and 12 comprises a valve V11, V12 that can be operated by the controller 2. Specifically, the valve V11 installed in the first feed line system 11 is so designed as to be controllable by the controller 2 in a manner permitting the inert gas supplied by the inert-gas source 3 to be injected into the atmosphere of the permanently inertized room 10 in regulated fashion at a first volume flow rate $V_{N2}$. In turn, the valve V12 installed in the second feed line system 12 is so designed as to be controllable by the controller 2 in a manner permitting the fresh air supplied by the fresh-air source 5 (in this case ambient outside air) to be injected into the atmosphere of the permanently inertized room 10 in regulated fashion at a second volume flow rate $V_L$.

Figure 4A:
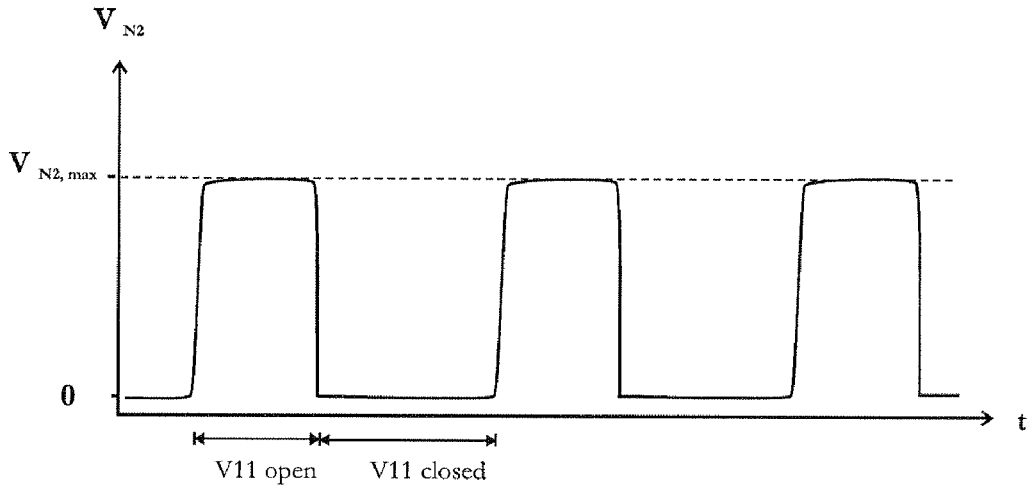
FIGS. 4*a* and 4*b* illustrate the time-based application of the valve control for the regulated injection of inert gas and, respectively, added air as implemented in the preferred embodiments of this invention.
Figure 4B:
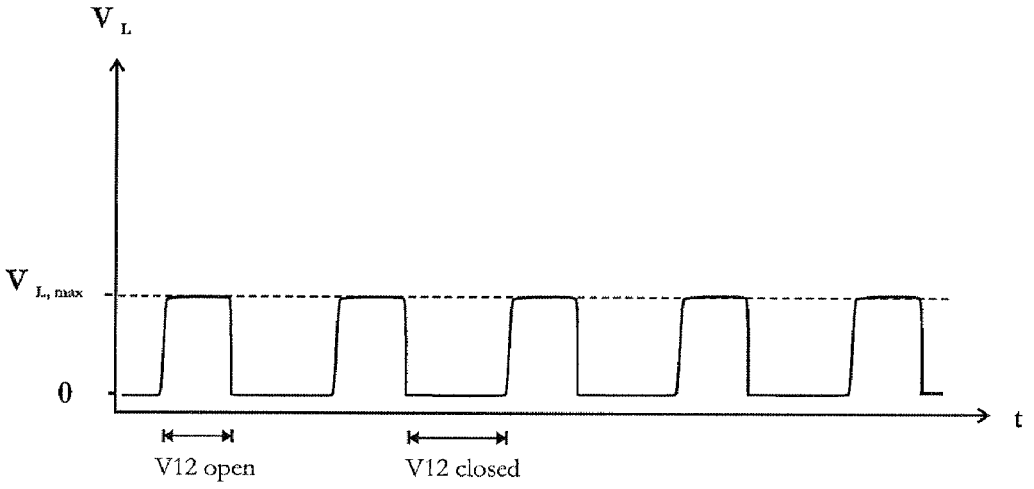

In one preferred implementation of the apparatus according to the invention, the valves V11 and V12 are designed as shut-off valves that can be switched between an open and a closed state. FIGS. 4*a* and 4*b* respectively show the time-based pattern along which, in this particular implementation, the controller 2 opens and closes the valves V11 and V12. It can be seen that the fresh air and the inert gas are delivered by the inert-gas source 3 and, respectively, the fresh-air source 5 in a pulsed mode. It will also be evident that the value of the first volume flow rate $V_{N2}$ at which the fresh air is injected into the atmosphere of the permanently inertized room 10 and the value of the second volume flow rate $V_L$ at which the inert gas is injected into the atmosphere of the permanently inertized room 10, are in each case time-based mean values.

The operation of the valve V11 installed in the first feed line system 11 is controlled for specifically regulating the oxygen concentration (or inert gas concentration) in the atmosphere of the permanently inertized room 10. To that effect, the setting of the valve V11 is such that the value of the first volume flow rate $V_{N2}$ fed into the room 10 is preferably just enough for maintaining the selected setpoint inertization level (with a particular control range where applicable) in the atmosphere of the permanently inertized room 10.

To make it possible with the apparatus 1 according to this invention to set the first volume flow rate $V_{N2}$ in a way as to maintain the inertization level in the permanently inertized room 10 with the highest attainable degree of accuracy, or to select as precise as possible a setpoint inertization level in the room 10, the preferred configuration of the inventive apparatus shown in FIG. 1 additionally comprises an oxygen measuring unit 7' with at least one and preferably several oxygen sensors 7 working in parallel, for measuring in continuous fashion or at scheduled times and events the oxygen concentration in the atmosphere of the permanently inertized room 10 and transmitting the measured values to the controller 2. The oxygen measuring unit 7', not illustrated in detail in FIG. 1, is preferably an aspiration-type system.

In turn, the operation of the valve V12 installed in the second feed line system 12 is controlled on the basis of the minimum air intake rate required for the permanently inertized room 10, i.e. just enough of an air intake rate to ensure the minimum air exchange needed for the room 10. As has been explained above, the minimum air intake rate, meaning the amount of added air to be injected per time unit into the permanently inertized room 10, is composed of the first volume flow rate $V_{N2}$ and the second volume flow rate $V_L$ (i.e. of the amounts per time unit of inert gas and fresh air injected into the room atmosphere). Specifically, the minimum air intake rate needed is that intake rate which is just enough to remove from the room atmosphere hazardous substances etc. to an extent where the concentration of these hazardous substances in the room atmosphere is safe for people or for products stored in the permanently inertized room 10.

Since, according to the invention, the determination of the value of the air intake into the room 10 for ensuring the necessary minimum air exchange takes into account the second volume flow rate $V_L$ at which fresh air or outside air is fed into the room atmosphere, as well as the first volume flow rate $V_{N2}$ at which inert gas is injected into the room atmosphere, the preferred design versions of the invention include provisions whereby the valve V12 installed in the second feed line system 12 is controlled by the controller 2 in such fashion that the second volume flow rate $V_L$ will have a value, or time-based mean value, just high enough to always permit only the amount of added air injected into the room 10 that is actually necessary for ensuring the minimum air exchange. To that effect, the second volume flow rate $V_L$, ideally by an appropriate control of the valve V12, will have a value that corresponds to the difference between the minimum added-air volume flow rate or air intake rate required for maintaining the minimum air exchange in the permanently inertized room 10 and the first volume flow rate $V_{N2}$ serving to maintain the specified inertization level. However, to ensure that there is an added safety margin with regard to the required minimum air exchange, it is possible to purposely select a slightly higher second volume flow rate $V_L$.

Accordingly, the valves V11 and V12 are controlled in a manner whereby, with regard to the minimum added-air volume flow rate, or air intake rate $V_F$, the following relation applies for the first volume flow rate $V_{N2}$ and the second volume flow rate $V_L$:

$$V_{N2}+V_L \geqq V_F$$

The necessary minimum added-air volume flow rate $V_F$ can be determined for instance by means of a hazardous-substance measuring unit 6' equipped with at least one and preferably several hazardous-substance detectors 6 working in parallel, serving to measure in continuous fashion or at scheduled times or events the hazardous-substance concentration in the atmosphere of the permanently inertized room 10 and to transmit the measured values to the controller 2. As in the case of the oxygen measuring unit 7', the hazardous-substance measuring unit 6' is preferably of the aspirating type.

In this context, it would be possible for the controller 2, on the basis of the measured hazardous substance concentration, to determine the required minimum added-air volume flow rate $V_F$, either in continuous fashion or at scheduled times or events, with the aid of a table stored in the controller 2. That table should contain a predefined correlation between the measured hazardous substance concentration and the required minimum added-air volume flow rate $V_F$. This correlation can (but does not have to) be adapted to the physical characteristics of the room 10 concerned, taking into account for instance the volume area of the room, the use of the room and other parameters.

Of course it would also be possible, by means of an added-air control signal stored in the controller 2, to preset a default minimum air exchange rate, which default value is then used in calculating the second volume flow rate.

Finally, it is also possible to design the controller in a way whereby, based on the minimum air exchange rate or minimum required added-air volume flow rate $V_F$ and on the value of the second volume flow rate $V_L$, itself established in the design stage of the device, appropriately controlling the valve V11 installed in the first feed line system 11, the value or time-based mean value of the first volume flow rate $V_{N2}$ can be so selected that the value or time-based mean value of the first volume flow rate $V_{N2}$ is greater than or equal to the difference between the minimum added-air volume flow rate $V_F$ required for maintaining the minimum air exchange for the permanently inertized room and the preset second volume flow rate $V_L$, without, of course, losing sight of the fact that the first volume flow rate $V_{N2}$ should always have a value or time-based mean value as is required for maintaining the specified inertization level in the atmosphere of the permanently inertized room.

Basically, however, the value of the second volume flow rate $V_L$ depends on the value of the first volume flow rate $V_{N2}$. Preferably, therefore, a suitable volume flow sensor S11 in one or several locations within the first feed line system 11 is used for measuring the first volume flow rate $V_{N2}$ especially in continuous fashion or at scheduled times or events and for transmitting the measurement results to the controller 2. Of course, it is equally possible to determine the first volume flow rate $V_{N2}$ as a function of the control signal which the controller 2 applies to the volume flow regulator V11 provided in the first feed line system 11.

Preferably, on the other hand, at least one sensor S12 is additionally provided in one or several locations within the second feed line system 12 for measuring the value of the second volume flow rate $V_L$ preferably in continuous fashion or at scheduled times or events and for transmitting the measurement results to the controller 2.

As has been indicated earlier, it is basically possible to input into the controller 2, in lieu of the measured values provided by the hazardous-substance measuring unit, an appropriate added-air control signal which added-air control signal establishes the minimum air exchange rate that must be maintained for the permanently inertized room 10. As an alternative or in addition, it is also possible for the added-air control signal to include information on the value that the first volume flow rate $V_{N2}$ must have to permit the inertization level established in the permanently inertized room 10 (with a certain control range where applicable) to be maintained by the continuous supply of replenishing inert gas. In this case there would be no need for the oxygen measuring unit 7'.

The fresh-air source 5 illustrated in FIG. 1 is in the form of a compressor that is or can be activated by the controller 2 and is designed to draw in "normal" outside air and, when activated by the controller 2, to feed fresh air into the second feed line system 12 at the appropriate fresh-air volume flow rate $V_L$.

The inert-gas source 3 illustrated in FIG. 1 is in the form of a generator system composed of a compressor 3*a*" that is or can be activated by the controller 2, and a molecular separator 3*a*', in particular a membrane-type or activated-charcoal adsorption unit. In the first preferred configuration, the compressor 3*a*" compresses "normal" outside air, then feeds it to the molecular separator 3*a*'. Since the controller 2 regulates the volume flow rate of the compressed air delivered by the compressor 3*a*" to the molecular separator 3*a*', it is possible to appropriately adjust the first volume flow rate $V_{N2}$ ultimately supplied to the first feed line system 11 by the inert-gas source 3. This, of course, can also be accomplished by suitably controlling the volume flow regulating valve V11 installed in the first feed line system 11.

As an alternative or in addition to the inert-gas generator system 3*a*', 3*a*" it would be possible to equip the inert-gas source 3 with an inert-gas reservoir 3*b*, indicated in FIG. 1 by a dotted outline. This inert-gas reservoir 3*b* may consist for instance of a battery of gas cylinders. The first volume flow rate $V_{N2}$ from the inert-gas reservoir 3*b* to the first feed line system 11 should be controllable via the regulating valve V11 appropriately operated by the controller 2.

According to the invention, the value or time-based mean value of the air intake into the permanently inertized room 10 per unit of time is adjusted in a way whereby the hazardous substances present in the atmosphere of the permanently inertized room 10 can be adequately removed and the inertization level specified for the permanently inertized room 10 can be maintained. In particular, however, the determination of the value or time-based mean value of the first volume flow rate $V_{N2}$ according to the inventive solution takes into account not only the proportional concentration of the hazardous substances to be removed from the atmosphere of the permanently inertized room 10 but also the value or time-based mean value for the first volume flow rate $V_{N2}$ at which inert gas is injected into the room atmosphere, insofar as the first volume flow rate $V_{N2}$ contributes to a certain extent to the required minimum air exchange, thus always injecting only enough fresh air into the atmosphere of the permanently inertized room 10 as is absolutely necessary for removing from the room atmosphere that proportional concentration of hazardous substances that has not already been removed, via an appropriate return-air exhaust system 4, by the injection of inert gas.

In this context, the configuration illustrated in FIG. 1 additionally includes in the permanently inertized room 10 a return-air exhaust system 4 in the form of an exhaust gate through which return air is removed from the permanently inertized room 10. In the preferred design version the return-air exhaust system 4 is a passive system operating by the positive-pressure principle. In this case the exhaust gate of the return-air exhaust system 4 is in the form of a check-valve flap.

To summarize, the solution according to the invention makes it possible to always inject into the atmosphere of the permanently inertized room 10 just enough fresh air or outside air as is needed to ensure the required minimum air exchange. If, for example, the required minimum air exchange for the permanently inertized room 10 calls for a fresh-air volume of 1000 $m^3$/day, the invention would permit the per-day injection into the room for instance of 700 $m^3$ outside air and 300 $m^3$ nitrogen-enriched air or oxygen-depleted air. An example of oxygen-depleted air to be used would be air with a nitrogen content of 90-95% by volume. The proportion of oxygen-depleted air is calculated on the basis of the residual oxygen concentration in the oxygen-depleted air, the inertization base level to be established in the room, the dimensional volume of the room and the air-tightness of the room.

Figure 2:
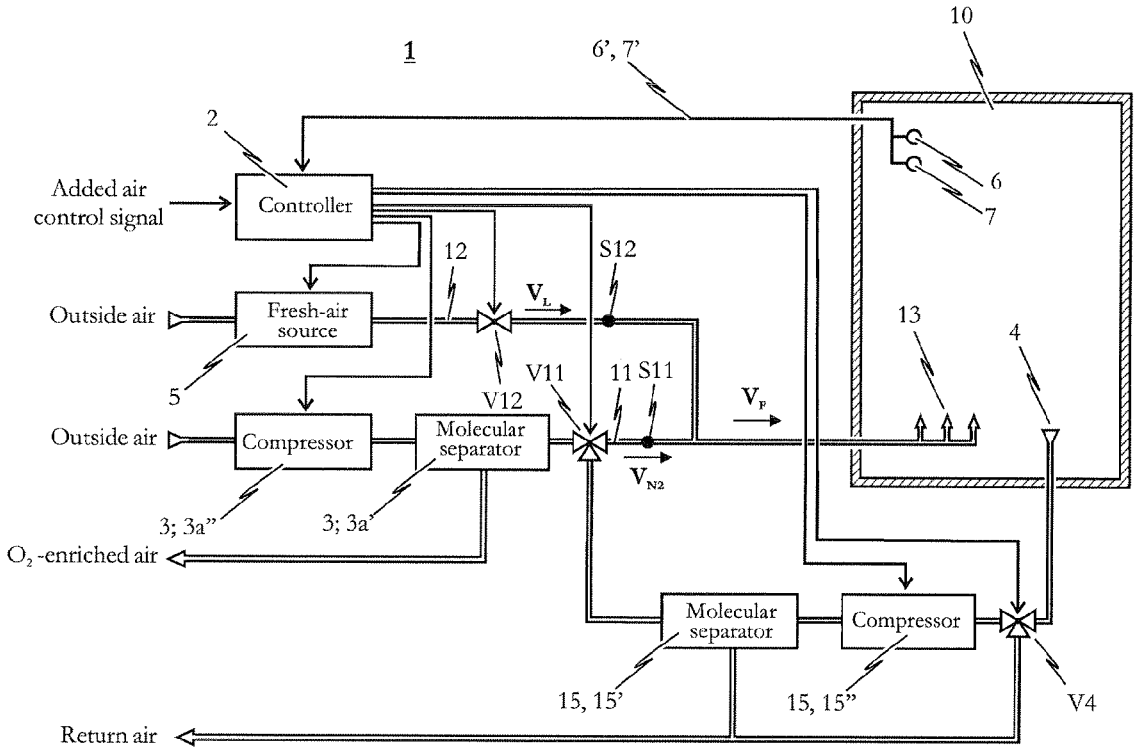
FIG. 2 shows a second preferred embodiment of the apparatus according to the invention for supplying added air in a controlled manner.

FIG. 2 shows a preferred design enhancement of the first embodiment of the apparatus 1 according to the invention, illustrated in FIG. 1. The second design version shown in FIG. 2 differs from the FIG. 1 configuration in that the return air drawn from the permanently inertized room 10 by means of the return-air exhaust system 4 is not completely discharged into the outside atmosphere but is at least partly passed through a filter system 15 from where it is then recirculated into the first feed line system 11 by way of the controllable valve V11 installed in the first feed line system 11.

Accordingly, in this "inert-gas feedback", part of the return air, removed from the permanently inertized room 10 via the return-air exhaust system 4 during the controlled air exchange, is suitably purified in the filter system 15 and then reinjected as inert gas into the permanently inertized room 10.

In the return-air purification process accomplished by means of the filter system 15, the toxic or otherwise harmful i.e. hazardous substances must be separated from the return air, thus permitting in ideal fashion the direct reinjection of the purified return air into the room 10. Since the purified return air contains an oxygen concentration that is identical to the proportional oxygen content in the atmosphere of the permanently inertized room 10, it would not be necessary in the case of a loss-less feedback, constituting a fully closed feedback loop, and of a hermetically sealed room enclosure, for the inert-gas source 3 to admix any additional inert gas and for the fresh-air source 5 to admix any additional fresh air to the purified return air in order to provide the required minimum air exchange or to maintain the specified inertization level in the permanently inertized room 10.

In practice, however, one cannot assume a loss-less inert-gas feedback loop or a hermetically sealed room enclosure, so that even the second preferred implementation of the invention, illustrated in FIG. 2, includes a fresh-air source 5 and an inert-gas source 3, each permitting activation by the controller 2 and adjustment of their respective gas volume flow rate $V_{N2}$, $V_L$ either by direct connection to and operation by the controller 2 or via the corresponding valves V11, V12 as regulated by the controller 2.

As shown in FIG. 2, the inert-gas feedback loop encompasses a three-way valve V4 for selecting that portion of the return air exhausted from the permanently inertized room 10 that is to be channeled to the filter system 15 of the inert-gas feedback loop and which will ultimately be reinjected into the room 10 as purified added air.

As has been indicated, the filter system 15 provided in the inert-gas feedback loop must be designed to separate from the return air the toxic or otherwise harmful or hazardous substances contained in the return air portion being channeled into the inert-gas feedback loop. This can be accomplished in particular by a system 15 in the form of an air reprocessing assembly comprising a molecular separator 15', especially a hollow-fiber membrane system and/or an activated charcoal adsorption system. In this particular case, the air reprocessing assembly 15 is additionally equipped with a compressor 15" which compresses the return air component that is channeled into the inert-gas feedback loop and then feeds it to the molecular separator 15'.

The molecular separator 15' splits the compressed return air along molecular lines, separating from the return air the toxic or otherwise harmful components (hazardous substances) in the return air recovered from the permanently inertized room 10 and discharging them to the outside by way of a first exit port. In turn, as shown in FIG. 2, a second exit port of the molecular separator 15' can be connected to the first feed line system 11 by way of the valve V11, allowing at least part of the purified return air, constituting an inert gas, to be fed into the first feed line system 11.

In other words, the enhanced configuration according to FIG. 2, comprising the inert-gas feedback loop and the air reprocessing assembly, constitutes an inert-gas exchanger. For regulating the inert-gas feedback rate, the controller 2 is preferably capable of operating the control valve V4 on the input side of the generator 15" and/or the generator 15" itself.

Figure 3:
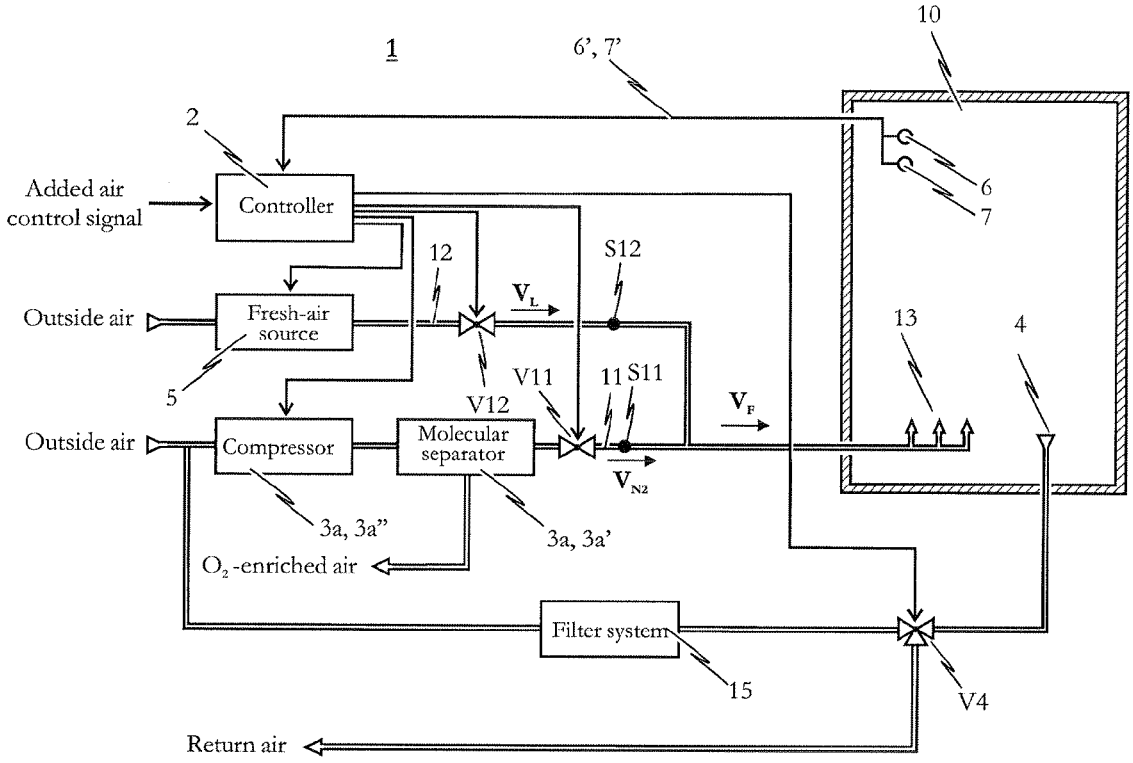
FIG. 3 shows a third preferred embodiment of the apparatus according to the invention for supplying added air in a controlled manner.

FIG. 3 shows a preferred enhancement of the second design version. As in the case of the first and second configurations according to FIGS. 1 and 2, the inert-gas source is an inert-gas generator 3*a* with a molecular separator 3*a*', especially one with a hollow-fiber membrane system or an activated charcoal adsorption system. The inert-gas generator 3*a* receives a compressed air mixture and delivers a nitrogen-enriched air mixture and the nitrogen-enriched air mixture delivered by the inert-gas generator 3*a* is fed, in controlled fashion, to the first feed line system 11 and, as an inert gas, to the permanently inertized room 10.

The configuration illustrated in FIG. 3 additionally comprises a return-air exhaust system 4 designed, preferably along the positive-pressure principle, to exhaust return air from the permanently inertized room 10 and to permit at least part of the return air to pass through an air reprocessing assembly 15 where the return air, withdrawn from the room 10 by the return-air exhaust system 4, can be filtered. At least part of the filtered return air is then channeled to the compressor 3*a*" of the inert-gas source 3.

In contrast to the second design version shown in FIG. 2, it is not necessary in the third implementation according to FIG. 3 for the air reprocessing assembly, provided in the inert-gas and return-air feedback loop, to be equipped with a compressor, identified in FIG. 2 by the reference number 15", and a molecular separator, shown in FIG. 2 under the reference number 15', in order to separate from the return air, by a suitable gas separation process, the toxic or harmful i.e. hazardous substances contained in that part of the return air withdrawn from the permanently inertized room 10 that is reinserted in the inert gas or return-air feedback loop.

Instead, in the configuration illustrated in FIG. 3, the return air processing is accomplished by means of the inert-gas source 3 in the form of an inert-gas generator 3*a*', 3*a*" into whose intake port the return air is fed. Since the return air that is fed into the inert-gas generator 3*a*', 3*a*" already contains an oxygen concentration which is essentially identical to the oxygen concentration in the atmosphere of the permanently inertized room 10, the primary function of the molecular separator 3*a*' of the inert-gas source 3 consists in the separation of any possible residual (especially gaseous) component of toxic or other harmful i.e. hazardous substances that might still be left in the return air, if these have not already been removed from the return air in the air reprocessing assembly.

It should be pointed out that the implementation of the invention is not limited to the embodiments illustrated in FIGS. 1 to 3 but is possible in numerous variations.

The invention has been described with reference to several embodiments. Obviously, modifications and alterations will occur to others upon a reading and understanding of this specification. It is intended to include all such modifications and alterations insofar as they come within the scope of the appended claims and the equivalents thereof.

LIST OF REFERENCE NUMBERS

1 device for the supply of added air
2 controller
3 inert-gas source
3*a*' molecular separator of the inert-gas source
3*a*" compressor of the inert-gas source
3*b* inert-gas reservoir
4 return-air exhaust system fresh-air source
6 hazardous-substance sensor
6' hazardous-substance measuring unit
7 oxygen sensor
7' oxygen measuring unit
10 permanently inertized room
11 first feed line system
12 second feed line system
13 added-air inlet nozzle assembly
V4 controllable valve in the return-air feedback loop
V11 controllable valve in the first feed line system
V12 controllable valve in the second feed line system
S11 volume flow sensor in the first feed line system
S12 volume flow sensor in the second feed line system
$V_F$ added-air volume flow rate
$V_L$ fresh-air volume flow rate
$V_{N2}$ inert-gas volume flow rate

The invention claimed is:

1. A method for the controlled feeding of added air into a permanently inertized room in which a predefined inertization level has been set and is maintained within a certain control range, said method including the following procedural steps:

providing for the supply of an inert gas, employing an inert-gas source, in particular an inert-gas generator and/or an inert-gas reservoir;

controlledly injecting of the supplied inert gas, via a first feed line system, into the atmosphere of the permanently inertized room at a first volume flow rate ($V_{N2}$) that is capable of maintaining the predefined inertization level and of removing from the room atmosphere airborne hazardous substances, especially toxic or otherwise harmful substances, biological agents and/or moisture;

providing for the supply of fresh air, in particular outside air, employing a fresh-air source; and controlledly injecting of the supplied fresh air, via a second feed line system, into the atmosphere of the permanently inertized room at a second volume flow rate ($V_L$), said value of the second volume flow rate ($V_L$) at which the fresh air is injected into the room atmosphere being determined by a minimum air exchange rate that is required for the permanently inertized room, and by the value of the first volume flow rate ($V_{N2}$) at which the inert gas is injected, wherein the second volume flow rate ($V_L$) is greater than or equal to the difference between a minimum added-air volume flow rate ($V_F$) necessary for maintaining the minimum air exchange rate required for the permanently inertized room, and the value of the first volume flow rate ($V_{N2}$) needed for maintaining the predefined inertization level of the atmosphere in the permanently inertized room.

2. The method as in claim 1, including the step of measuring, preferably in continuous fashion or at scheduled times or events, the concentration of hazardous substances in the room atmosphere in one or several locations within the permanently inertized room by means of one or several sensors.

3. The method as in claim 1 or 2, including the step of measuring, preferably in continuous fashion or at scheduled times or events, the oxygen concentration in the room atmosphere in one or several locations within the permanently inertized room by means of one or several sensors.

4. The method as in claim 2, including the step of transmitting concentration values of the hazardous substances and, respectively, the oxygen to a controller.

5. The method as in claim 4, whereby the minimum air exchange rate required for the permanently inertized room is measured as the concentration of hazardous substances increases and reduced as the concentration of hazardous substances decreases.

6. The method as in claim 4, whereby the first volume flow rate ($V_{N2}$) is increased as the oxygen concentration in the room atmosphere is increased and reduced as the oxygen concentration decreases.

7. The method as in claim 4, whereby, preferably in continuous fashion or at scheduled times or events, at least one controller determines the required minimum added-air volume flow rate ($V_F$) as a function of the measured values of hazardous substances with the aid of a look-up table stored in the controller (2).

8. The method as in claim 1 or 2, including the step of measuring, preferably in continuous fashion or at scheduled times or events, the value of the first volume flow rate ($V_{N2}$) in one or several locations within the first feed line system by means of one or several sensors.

9. The method as in claim 1 or 2, including the step of measuring, preferably in continuous fashion or at scheduled times or events, the value of the second volume flow rate ($V_L$) in one or several locations within the second feed line system by means of one or several sensors.

10. The method as in claim 1 or 2, including making the proportional oxygen content in the inert gas supplied by the inert-gas source 2 to 5% by volume and the proportional oxygen content in the fresh air supplied by the fresh-air source approximately 21% by volume.

11. Apparatus for the controlled feeding of added air into a permanently inertized room in which a predefined inertization level is set and maintained within a certain control range, said apparatus comprising:

an inert-gas source, in particular an inert-gas generator and/or an inert-gas reservoir for supplying an inert gas;

a fresh-air source for supplying fresh air, in particular outside air;

a first feed line system, connectable to the inert-gas source, for the controlled injection of the supplied inert gas into the atmosphere of the permanently inertized room at a first volume flow rate ($V_{N2}$) capable of maintaining the predefined inertization level and of removing from the room atmosphere hazardous substances, especially toxic or other harmful substances, biological agents and/or moisture; and a second feed line system, connectable to the fresh-air source, for the controlled injection of the supplied fresh air into the atmosphere of the permanently inertized room at a second volume flow rate ($V_L$), wherein the value of the second volume flow rate ($V_L$) at which the fresh air is injected is based on the minimum air exchange rate required for the permanently inertized room as well as on the value of the first volume flow rate ($V_{N2}$) at which the inert gas is injected, wherein the apparatus additionally includes at least one controller designed to regulate the value of the first volume flow rate ($V_{N2}$) at which the inert gas is injected into the atmosphere of the permanently inertized room on the basis of the inertization level to be maintained in the permanently inertized room, and/or the value of the first volume flow rate ($V_{N2}$) at which the inert gas is injected on the basis of the minimum air exchange rate required for the permanently inertized room, said at least one controller being so designed that, based on the required minimum air exchange rate and on the value of the first volume flow rate ($V_{N2}$), said controller regulates the value of the second volume flow rate ($V_L$), by operating a valve (V12) provided in the second feed line system (12), in a manner whereby the value of the second volume flow rate ($V_L$) is greater than or equal to the difference between a minimum added-air volume flow rate ($V_F$) required for maintaining the minimum air exchange rate needed for the permanently inertized room, and the value of the first volume flow rate ($V_{N2}$) for maintaining the predefined inertization level in the atmosphere of the permanently inertized room.

12. The apparatus as in claim 11, wherein said at least one controller is designed to regulate the value of the first volume flow rate ($V_{N2}$) at which the inert gas is injected into the atmosphere of the permanently inertized room on the basis of the inertization level that is to be maintained in the permanently inertized room and/or to regulate the value of the first volume flow rate ($V_{N2}$) at which the inert gas is injected on the basis of the minimum air exchange rate required for the permanently inertized room.

13. The apparatus as in claim 11, additionally including an aspirative oxygen measuring unit with at least one and preferably several oxygen sensors working in parallel to continuously or at scheduled times or events measure the oxygen concentration in the atmosphere of the permanently inertized room and to transmit the measured values to said at least one controller.

14. The apparatus as in claim 11 or 12, additionally including an aspirative hazardous-substance measuring unit with at least one and preferably several hazardous substance sensors working in parallel to continuously or at scheduled times or events measure the concentration of hazardous substances in the atmosphere of the permanently inertized room and to transmit the measured values to said at least one controller.

15. The apparatus as in claim 13, wherein the at least one controller is designed to increase the value of the first volume flow rate ($V_{N2}$) as the oxygen concentration in the room atmosphere increases and to reduce said value as the oxygen concentration decreases, preferably by operating a controllable valve in the first feed line system.

16. The apparatus as in claim 13, wherein the at least one controller is designed to increase the minimum air exchange rate required for the permanently inertized room as the concentration of hazardous substances in the room atmosphere increases and to reduce it as the concentration of hazardous substances decreases.

17. The apparatus as in claim 11 or 12, wherein said at least one controller is designed to determine, preferably in continuous fashion or at scheduled times or events, the required minimum added-air volume flow rate ($V_F$) as a function of the concentration of hazardous substances by means of a look-up table stored in said at least one controller.

18. The apparatus as in claim 11 or 12, additionally including at least one sensor in one or several locations within the first feed line system for measuring the value of the first volume flow rate ($V_{N2}$), preferably in continuous fashion or at scheduled times or events, and for transmitting the measurement results to the at least one controller.

19. The apparatus as in claim 11 or 12, additionally including at least one sensor in one or several locations within the second feed line system for measuring the value of the second volume flow rate ($V_L$), preferably in continuous fashion or at scheduled times or events, and for transmitting the measurement results to the at least one controller.

20. The apparatus as in claim 12, additionally comprising a return-air exhaust system designed to remove return air from the permanently inertized room in controlled fashion, as well as an air reprocessing unit for the reprocessing and/or filtering of the return air extracted from the room by the return-air exhaust system, with at least part of the reprocessed or filtered return air being fed to the inert-gas source as available inert gas.

21. The apparatus as in claim 20, in which the return-air exhaust system features at least one controllable exhaust gate, in the form of a mechanically, hydraulically or pneumatically operable exhaust shutter that can be controlled so as to regulate the withdrawal of return air from the permanently inertized room, said minimum of one exhaust gate preferably constituting a fire barrier.

22. The apparatus as in claim 20 or 21, in which the air reprocessing unit encompasses a molecular separator, in particular a hollow-fiber membrane system and/or an activated-charcoal adsorption system.

23. The apparatus as in claim 20 or 21, in which the inert-gas source is an inert-gas generator with a molecular separator, in particular a hollow-fiber membrane system and/or an activated-charcoal absorption system, said molecular separator is fed a compressed air mixture and the inerts gas generator delivers a nitrogen-enriched air mixture, the nitrogen-enriched air mixture delivered by the inert-gas generator, constituting an inert gas, is injected in controlled fashion into the permanently inertized room, and the air mixture fed to the inert-gas generator is at least in part composed of the filtered return air.

* * * * *